United States Patent [19]

Cushing

[11] 4,069,425

[45] Jan. 17, 1978

[54] FULL-TIME FLOOD PROTECTION CONTROL FOR DISHWASHER

[75] Inventor: Donald S. Cushing, Louisville, Ky.

[73] Assignee: General Electric Company, Louisville, Ky.

[21] Appl. No.: 692,442

[22] Filed: June 3, 1976

[51] Int. Cl.[2] ..... H01H 35/18

[52] U.S. Cl. ..... 134/57 D; 307/118

[58] Field of Search ..... 307/118, 141, 141.4, 307/141.8; 134/56 D, 57 D, 57 DL, 186

[56] References Cited

U.S. PATENT DOCUMENTS

| | | | |
|---|---|---|---|
| 3,439,687 | 4/1969 | Cushing | 134/57 D |
| 3,876,338 | 4/1975 | Jarvis | 134/186 |

*Primary Examiner*—Robert K. Schaefer
*Assistant Examiner*—Morris Ginsburg
*Attorney, Agent, or Firm*—Francis H. Boos

[57] ABSTRACT

A dishwasher control circuit including a single-pole, double-throw door interlock switch and a water level sensing means, which sensing means includes a single-pole, double-throw switch. The sensing means switch connects the water inlet valve control solenoid and the drain valve control under normal operating conditions, and connects in series a direct power line and the pump motor and drain solenoid during flooding conditions. The control provides continuous protection against flooding in the dishwasher.

6 Claims, 3 Drawing Figures

FULL-TIME FLOOD PROTECTION CONTROL FOR DISHWASHER

BACKGROUND OF THE INVENTION

This invention relates generally to automatic dishwashers and, more specifically, to an improved control system which gives continuous protection against overfill flooding irrespective of whether the dishwasher is in use or standing idle.

Operation of conventional automatic dishwashers typically involves one or more pre-rinse periods, a wash period, and possibly one or more post-rinse periods. Frequently, there is also a drying period which may include the addition of heat to the wash chamber as a means of expediting drying.

Control means are provided to sequentially energize and de-energize the various electrically-operated components of the automatic dishwasher to perform the above-described operational cycle. Usually, a sequence control device having a timer motor and several cam-operated switches is provided with each switch controlling one of the components.

Unfortunately, however, such a sequence control device makes no provision for the unexpected failure of various components. Specifically, avoidance of overflow or flooding is a potential threat, resulting from failure of any of a number of components.

Flooding control systems have been provided in the past. U.S. Pat. No. 3,876,338 is an example of such a system wherein overflow is prevented by providing a unidirectional pump system for both recirculation and draining. This function is accomplished by selectively air-locking the drain pump during the recirculation operation to prevent draining of the tub at that time. However, the invention of U.S. Pat. No. 3,876,338 does not protect against fill valve failure while the dishwasher is sitting idle.

The invention of this disclosure overcomes the objections inherent in prior art machines and provides a 24 hour flood control protection device for dishwashers.

SUMMARY OF THE INVENTION

This invention is related to automatic dishwashers having a washing chamber and means including an electrically-operated inlet valve for supplying liquid to the wash chamber. More specifically, the invention provides an improved means for preventing the flooding of a kitchen, if, for some reason, the water inlet valve (or some other component) fails, either during the operation of the dishwasher or during the time in which it is idle. More specifically, the invention includes an automatic dishwasher having a washing enclosure, a pump and motor assembly to circulate water within said enclosure, a dishwasher fill means including a high-impedance solenoid-controlled water inlet valve for supplying liquid to the enclosure, a low-impedance electrcial control component to control the flow of liquid from the enclosure, and a control system comprising: a single-pole, double-throw door interlock switch; a timer including a motor and three cam-actuated switches, one of said switches controlling the power to the timer motor, another controlling the power to the motor and pump assembly, and the third controlling the power to the solenoid control of the water valve and drain valve; a water level sensor, independent of the dishwasher fill means, including a switch, said water level sensor switch being of the single-pole, double-throw type and connecting said high-impedance solenoid and said low-impedance electrical control component in series during normal operation and connecting said motor and pump assembly to a power supply during flooding conditions; further, said single-pole, double-throw door interlock switch functioning to supply power from said water level sensor switch to said motor and pump assembly when said door is in its unlatched position.

The invention described and claimed in this application has been found to be a useful, expedient means of providing full-time flood protection in an automatic dishwasher.

DESCRIPTION OF THE PREFERRED EMBODIMENT

Figure 1:
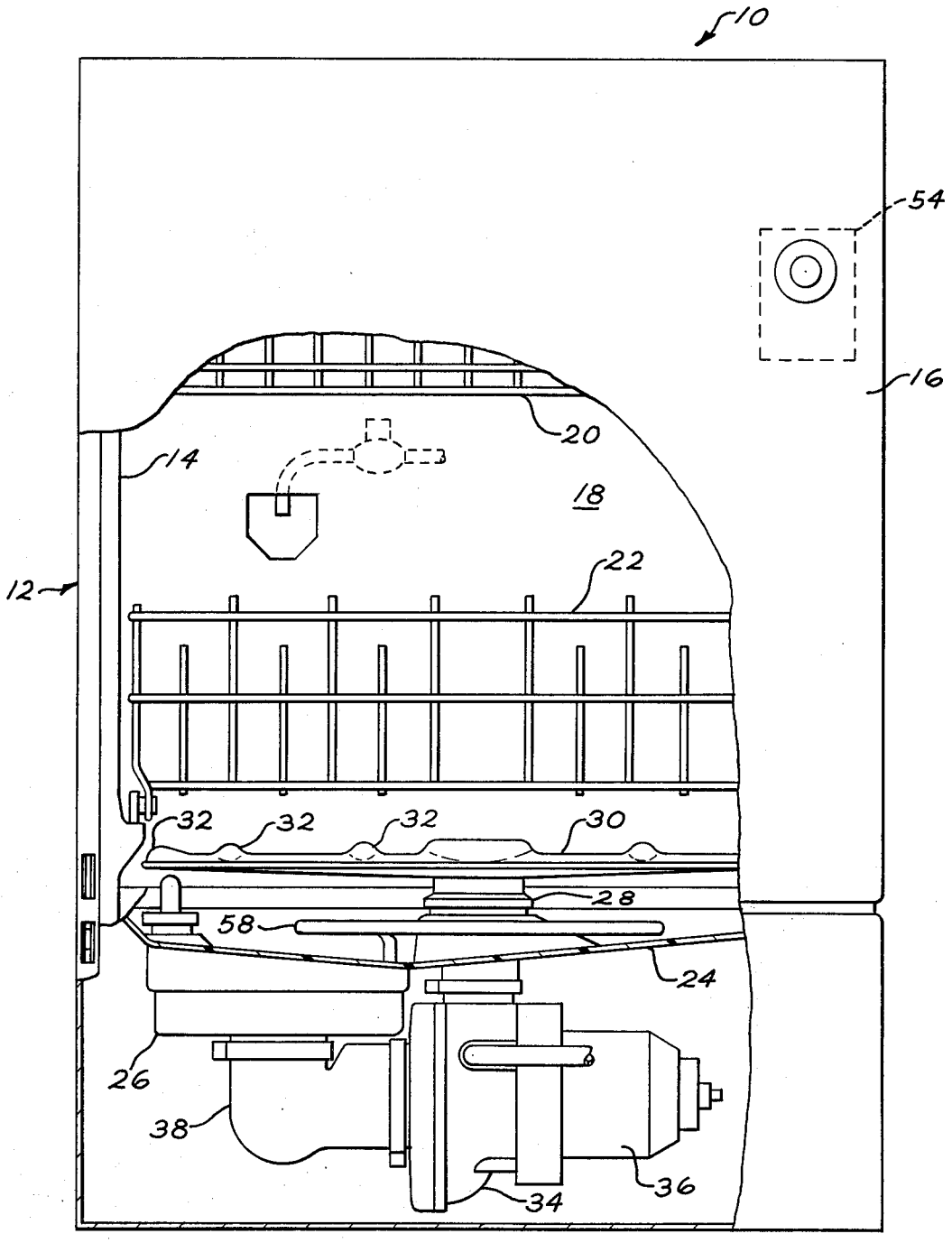
FIG. 1 is a cutaway elevational view of an automatic dishwasher employing the present invention.

Referring to FIG. 1, there is illustrated an automatic dishwasher 10 having an outer cabinet 12 housing a tub 14. Tub 14 cooperates with a door 16 to define a washing chamber 18 therewithin. Located within the washing chamber 18 are dish-supporting racks 20 and 22, which are adapted to receive and support articles to be washed in the dishwasher. When door 16 is opened, the racks can be at least partially withdrawn for loading and unloading of the dishes.

The lower extremity of washing chamber 18 is defined by a bottom wall 24 which gradually slopes to a low point near the center of the dishwasher. Disposed below the low point is a sump 26 which may be formed integrally with the bottom wall or which may be a separate element secured to the edges of a hole in the bottom wall.

Figure 2:
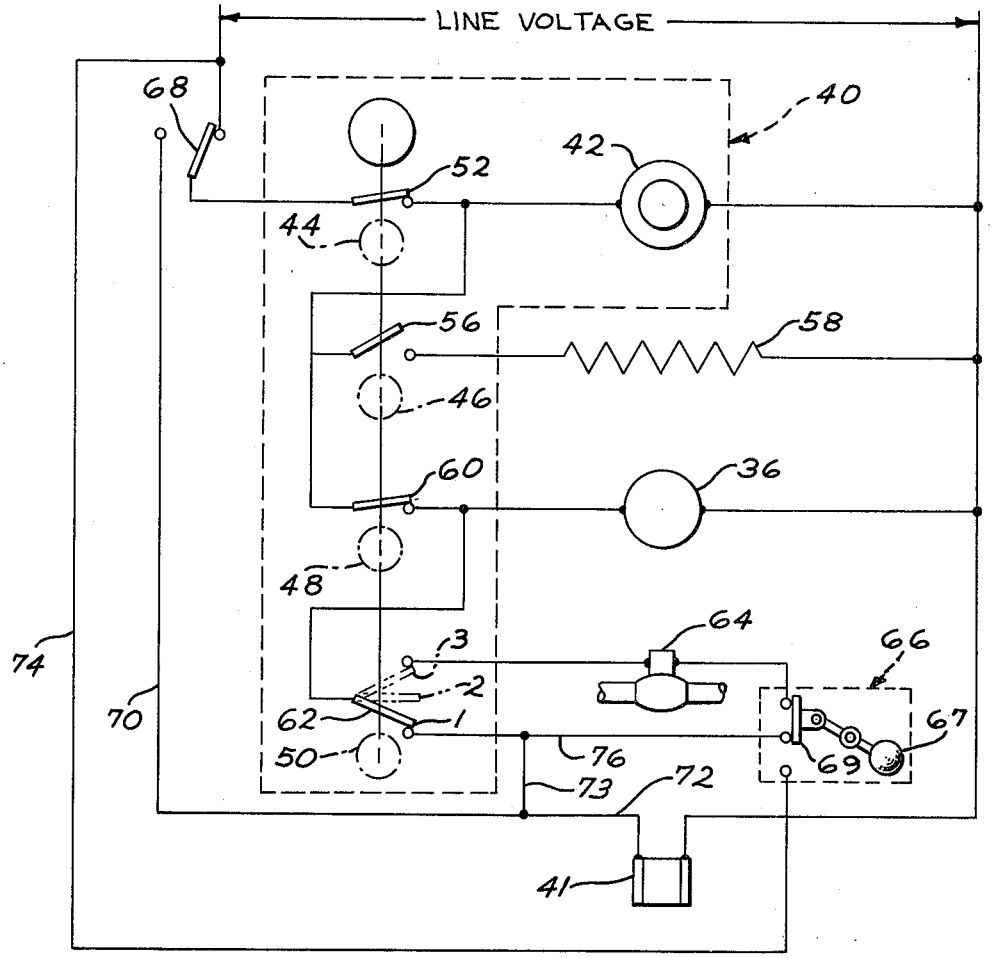
FIG. 2 is a schematic wiring diagram of the controls of this invention.
Figure 3:
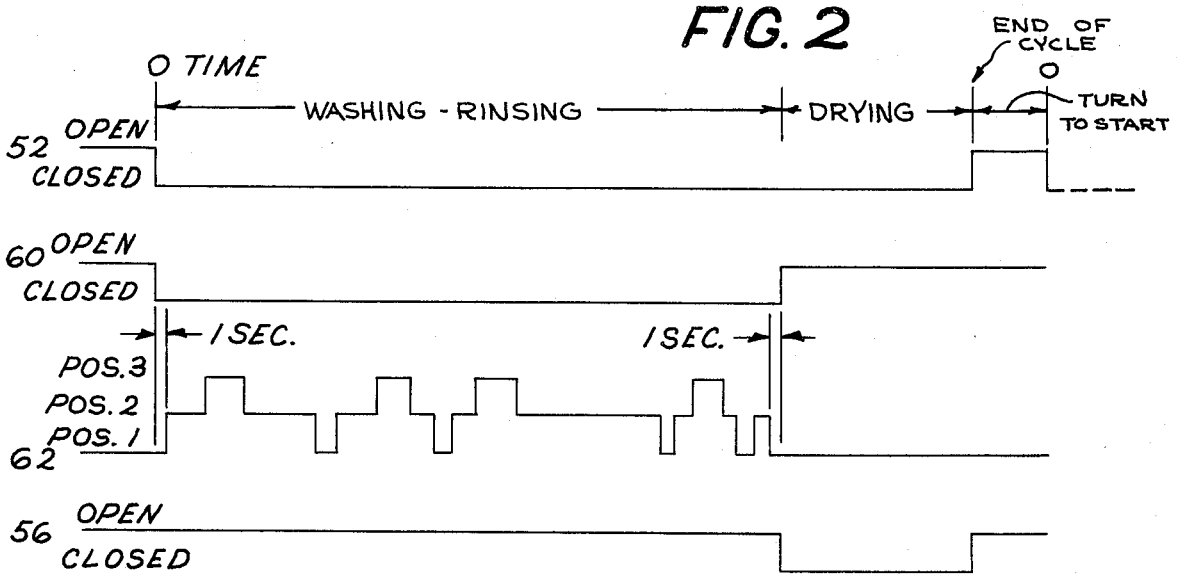
FIG. 3 is a schematic representation of the action of the timer-controlled switches in the circuitry of FIG. 2.

Projecting upwardly from bottom wall 24, near the center of wash chamber 18, is a pedestal 28 which supports a rotatable spray arm 30. Spray arm 30 includes a plurality of orifices 32 through which washing fluid is emitted to effectuate a wash action upon the articles supported by racks 20 and 22. At least one of the orifices 32 is directed such that the reaction force created by washing fluid passing therethrough causes rotation of the arm 30 about a substantially vertical axis. Washing fluid is propelled into spray arm 30 by a pump 34 which is driven by an electric motor 36. Pump and motor 34 and 36, respectively, are secured together to form a pump-motor assembly which is supported from bottom wall 24. A flexible boot or conduit 38 interconnects sump 26 with the inlet of pump 34. Referring now to FIGS. 2 and 3, the control system of the present invention is illustrated in schematic form. As can be seen, there exists a sequence control means 40. As can be seen, sequence control means 40 includes a timer motor 42, which drives through direct mechanical linkage, the cams 44, 46, 48 and 50. Cam 44 controls the action of switch 52, which provides the current to timer motor 42. It becomes obvious that it is necessary to manually rotate cam 44 until switch 52 is closed. This is accomplished by the user when the timer dial 54 is set to the "On" position. Similarly, cam 46 controls switch 56 which, in turn, supplies power to an electric resistance heating element 58 in the wash chamber. Heating element 58 may be used to supply heat to the washing fluid or heat for drying of the dishes after the wash cycle is complete. In the present instance, the switch profile (FIG. 3) shows that the heating unit is being used only to supply heat for drying the dishes after the wash cycle.

Cam 48 controls switch 60 which, in turn, supplies power to motor 36. Motor 36 powers pump 34 to circulate the water and also drain the washing chamber, as required.

Lastly, cam 50 controls switch 62 which is a three-position switch which is normally in position 1. Upon rotation of cam 50, switch 62 is moved to position 2 and, subsequently, to position 3. In position 1, switch 62 electrically connects drain solenoid 41 and motor 36. In position 2, switch 62 is open, while, in position 3, switch 62 connects water inlet valve solenoid 64 in the circuit.

Essential to this invention, both with respect to its function and its placement in the circuitry, is water level sensing unit 66. This sensing unit includes a float 67 and a two-position switch 69. This unit is located in series between the high-impedance water valve solenoid 64 and the low-impedance drain solenoid 41. (Note, however, this drain solenoid 41 could also be a low-impedance drain pump motor.) Referring to FIG. 2, it can be seen that, when switch 62 is in position 3 and switches 52 and 60 are closed, water will be introduced. However, because of the difference in impedance, the drain solenoid will not be actuated. But, if the water valve were to stick open, the float would rise and switch 69 would shift positions to electrically connect the drain solenoid. (Recall, switch 62 would be in position 3 at this time.) Then, since switch 60 is closed, the pump would remove the water and prevent flooding.

From FIG. 2, it is possible to see that the present invention protects against flooding of a dishwasher, due to any single failure 100% of the time. In this regard, it should be noted that door interlock switch 68 makes contact with line 70 which, in turn, is electrically connected through line 72 to drain solenoid 41. Thus, should the water valve fail when the dishwasher cycle has been interrupted, the door will be in its unlatched position, float 67 would rise and switch 69 would shift to connect line 74 and line 76. Thus, power could flow through switches 68, 52, and 60 to motor 36, and directly to drain solenoid 41, to effect pumping out of liquid.

Similarly, if the dishwasher motor is idle in the dry portion or at end of cycle, but the door is in its latched position and flooding occurs, float 67 will be actuated and will cause switch 69 to move to its lower contact position, whereby power will travel down line 74 through lines 76, 73 to actuate drain solenoid 41. Similarly, power will be transmitted through line 76, through normally-closed switch 62, to the pump motor 36, and pumping will begin.

By further analysis, it can be discerned that any other failure mode that is possible will be protected against, providing there is but a single failure in the dishwasher mechanism or control.

FIG. 3 shows the relative times that the switches 52, 56, 60, and 62 are open or closed, or, in the case of FIG. 62, in one of the three positions. From this diagram, it is possible to trace the power flow when any hypothetical failure situation is envisioned. From this information, it is possible to determine how the invention would protect against it. Notice, in FIG. 3, there are two separate one-second intervals, which assures overlap of switch actions of 60 and 62, one interval at the beginning of the wash cycle where switch 60 is switched to its closed position before switch 62 switches from position 1 to its neutral position 2, and the other interval nearing the end of the cycle where switch 62 switches to its position 1 at the time that switch 60 switches to its "Off" position. This feature integrated in the sequence timer control always connects drain solenoid 41, through switch 62, to motor 36 whenever the dishwasher is off. Thus, the dishwasher has the capability of responding to flood conditions, because power will be supplied to the motor and drain solenoid by float switch 69.

Having thus described the invention, what is claimed is:

1. An automatic dishwasher having a washing enclosure, a pump and motor assembly to circulate water within said enclosure, a dishwasher fill means including a high-impedance solenoid-controlled water inlet valve for supplying liquid to the enclosure, a low-impedance electrical control component to control the flow of liquid from the enclosure, and a control system comprising:

a single-pole, double-throw door interlock switch;

a timer including a motor and three cam-actuated switches, one of said switches controlling the power to the timer motor, another controlling the power to the motor and pump assembly, and the third controlling the power to the solenoid control of the water valve and drain valve;

a water level sensor, independent of the dishwasher fill means, including a switch, said water level sensor switch being of the single-pole, double-throw type and connecting the high-impedance solenoid and said low-impedance electrical control component in series during normal operation and connecting said motor and pump assembly to a power supply during flooding conditions;

further, said single-pole, double-throw door interlock switch functioning to supply power from said water level sensor switch to said motor and pump assembly when the door is in its unlatched position.

2. The dishwasher of claim 1 wherein said low-impedance electrical control component is a solenoid controlled outlet valve.

3. The dishwasher of claim 1 further comprising an electrical heating element to facilitate drying of articles within said washing enclosure.

4. The dishwasher of claim 1 wherein said water level sensor switch includes a float having first and second operative positions and being located to move to said second operative position as the liquid level within the washing enclosure exceeds a predetermined height, the float, when in said first position allowing energizing of said inlet valve, but, when in said second operative position energizing said pump and motor and preventing energization of said inlet valve.

5. The dishwasher of claim 2 wherein said control system includes at least two switches, the first switch controlling power flow to said pump and motor assembly under normal operating conditions, and the second switch controlling power flow to both the low-impedance drain solenoid and the high-impedance water inlet valve, said two switches being positioned to be preselectively actuated thereby providing that the second switch can transmit power reversibly therethrough to said motor and pump assembly when said first switch is open.

6. The dishwasher of claim 1 wherein said low-impedance electrical control component is a low-impedance drain pump motor.

* * * * *